US009494894B2

(12) United States Patent
Tetsuno et al.

(10) Patent No.: US 9,494,894 B2
(45) Date of Patent: Nov. 15, 2016

(54) IMAGE FORMING APPARATUS

(71) Applicant: CANON KABUSHIKI KAISHA, Tokyo (JP)

(72) Inventors: Shuichi Tetsuno, Kawasaki (JP); Shinji Katagiri, Yokohama (JP); Masaru Ohno, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/566,472

(22) Filed: Dec. 10, 2014

(65) Prior Publication Data

US 2015/0168877 A1 Jun. 18, 2015

(30) Foreign Application Priority Data

Dec. 12, 2013 (JP) ..... 2013-256639

(51) Int. Cl.
*G03G 15/16* (2006.01)

(52) U.S. Cl.
CPC .. *G03G 15/1605* (2013.01); *G03G 2215/1614* (2013.01)

(58) Field of Classification Search
CPC ..... G03G 15/1605; G03G 2215/1614
See application file for complete search history.

(56) References Cited

U.S. PATENT DOCUMENTS

| | | | | |
|---|---|---|---|---|
| 6,081,679 | A * | 6/2000 | Yamane | G03G 21/0064 399/100 |
| 2004/0120729 | A1* | 6/2004 | Uyama | G03G 21/0064 399/129 |
| 2006/0140687 | A1* | 6/2006 | Furukawa | 399/313 |
| 2010/0239334 | A1* | 9/2010 | Iwami et al. | 399/313 |
| 2013/0164052 | A1* | 6/2013 | Okamoto | 399/313 |
| 2013/0266348 | A1* | 10/2013 | Yoshimura et al. | 399/302 |
| 2014/0037344 | A1* | 2/2014 | Yamane et al. | 399/313 |

FOREIGN PATENT DOCUMENTS

| | | | |
|---|---|---|---|
| CN | 101995793 | A | 3/2011 |
| CN | 103080574 | A | 5/2013 |
| JP | 2000-337464 | A | 12/2000 |
| JP | 2006-267243 | A | 10/2006 |
| JP | 2009-223285 | A | 10/2009 |
| JP | 2011-232785 | A | 11/2011 |

* cited by examiner

*Primary Examiner* — David Gray
*Assistant Examiner* — Carla Therrien
(74) *Attorney, Agent, or Firm* — Canon U.S.A. Inc., IP Division

(57) ABSTRACT

Wheels configured to be supported by a metallic roller on an outside of end portions of a contact area and inside of end portions of the transfer belt in terms of a width direction are provided, and the wheels are formed of a non-conductive resin.

12 Claims, 11 Drawing Sheets

IMAGE FORMING APPARATUS

BACKGROUND OF THE INVENTION

Field of the Invention

This disclosure relates to an image forming apparatus on the basis of an electrophotographic system such as copying machines and printers.

Description of the Related Art

In the related art, as an image forming apparatus on the basis of an electrophotographic system, an image forming apparatus provided with an intermediate transfer belt as an intermediate transfer member is known. In the image forming apparatus of the related art, voltage is applied from a first voltage supply (power circuit) to a primary transfer member arranged on a portion opposing a photosensitive drum via an intermediate transfer belt, so that a primary transfer potential is generated at a primary transfer portion of the intermediate transfer belt that comes into contact with the photosensitive drum. Then, with a potential difference generated between the photosensitive drum and the intermediate transfer belt, a toner image formed on a surface of the photosensitive drum as an image bearing member is primarily transferred onto the intermediate transfer belt (primary transfer process). Subsequently, this primary transfer process is repeatedly performed for toner images in the respective colors to form a toner in a plurality of colors on the surface of the intermediate transfer belt. Subsequently, as a secondary transfer process, the toner images in a plurality of colors formed on the surface of the intermediate transfer belt are secondarily transferred as a job lot to a surface of a recording material such as paper by applying voltage from a second voltage supply to a secondary transfer member. The toner images transferred as a job lot are then fixed to the recording material by a fixing device.

Japanese Patent Laid-Open No. 2011-232785 discloses a configuration of a rigid member such as a metallic roller is brought into contact with the intermediate transfer belt as the primary transfer portion to which voltage is applied from the first voltage supply. In order to prevent the photosensitive drum from being worn by the metallic roller, the metallic roller proposes, a configuration in which the metallic roller is arranged on the downstream side of a contact area between the intermediate transfer belt and the photosensitive drum in a direction of movement of the intermediate transfer belt is proposed.

However, in a primary transfer configuration in Japanese Patent Laid-Open No. 2011-232785, since a contact member is a rigid member, the intermediate transfer belt may be bent in a width direction orthogonal to the direction of movement of the intermediate transfer belt. Specifically, bending of the intermediate transfer belt may occur in a boundary portion between the intermediate transfer belt and the contact area of the contact member in the width direction. If the bending occurs in the boundary portion in the width direction, unevenness in contact may occur in the contact area between the intermediate transfer belt and the photosensitive drum, so that there arises a problem of an occurrence of transfer failure.

SUMMARY OF THE INVENTION

This disclosure prevents an occurrence of transfer failure in association with bending of a transfer belt in a configuration in which a contact member of a rigid member is brought into contact with a transfer belt such as an intermediate transfer belt.

There is provided an image forming apparatus including:

an image bearing member configured to bear a toner image;

a transfer belt being a movable endless belt, and configured to transfer a toner image to a transfer material;

a contact member being a rigid member having conductivity and coming into contact with an inner peripheral surface of the transfer belt, the contact member being arranged so that an image forming area in which the toner image on the image bearing member is formed is included within a contact area of the contact member with respect to the transfer belt of the contact member in terms of a width direction orthogonal to a direction of movement of the transfer belt; and a rotating member supported by the contact member on an outside of end portions of the contact area and on an inside of end portions of the transfer belt in terms of the width direction, the rotating member being a non-conductive resin.

There is also provided an image forming apparatus including:

an image bearing member configured to bear a toner image;

a transfer belt being a movable endless belt, and configured to transfer a toner image to a transfer material; and a contact member being a rigid member having conductivity and coming into contact with an inner peripheral surface of the transfer belt, the contact member being arranged so that an image forming area in which the toner image on the image bearing member is formed is included within a contact area of the contact member with respect to the transfer belt of the contact member in terms of a width direction orthogonal to a direction of movement of the transfer belt, wherein the contact member includes a non-conductive portion configured to come into contact with the transfer belt on an outside of end portions of the contact area and on an inside of end portions of the transfer belt in terms of the width direction.

Further features of the present invention will become apparent from the following description of exemplary embodiments with reference to the attached drawings.

DESCRIPTION OF THE EMBODIMENTS

Figure 1:
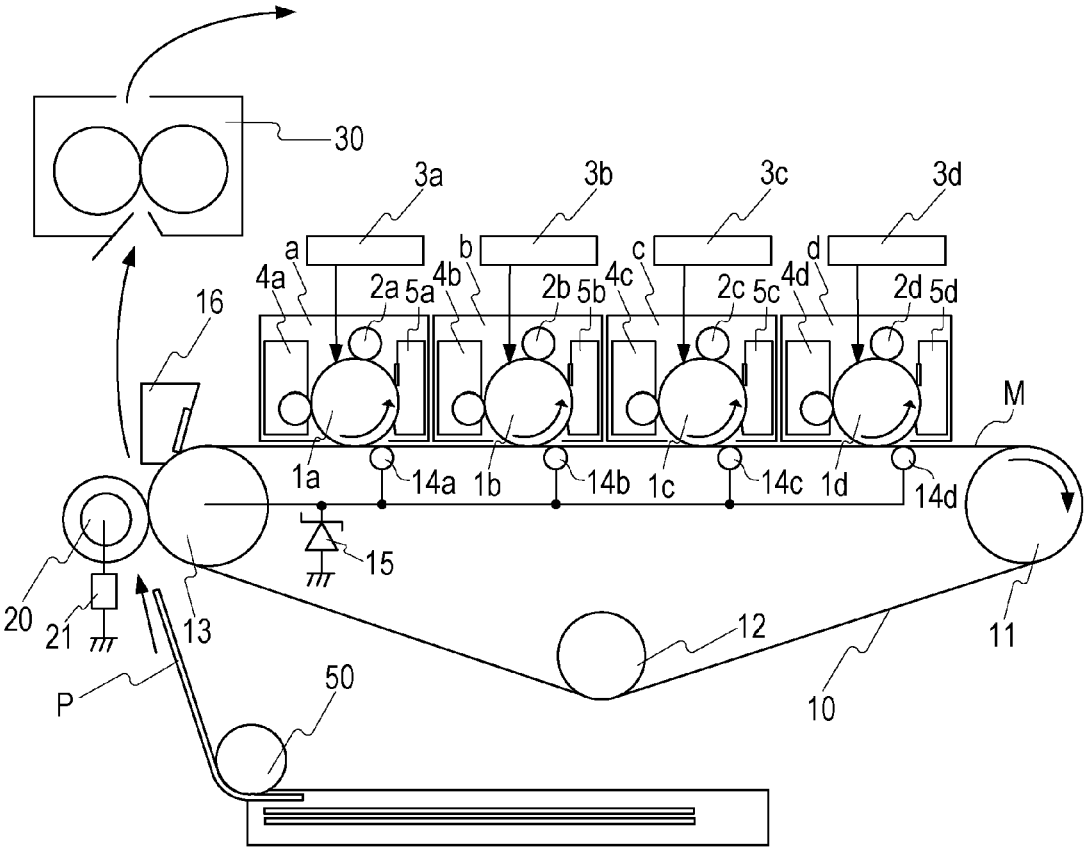
FIG. 1 is a schematic drawing for explaining an image forming apparatus of a first embodiment.

Referring now to the drawings, preferred embodiments of this disclosure will be described below by examples in detail. However, dimensions, materials, shapes, and relative arrangements of components described in the following embodiments are to be modified as needed depending on configurations and conditions of the apparatuses to which this disclosure is applied. Therefore, this disclosure is not intended to limit the scope of the invention only to description given below unless otherwise specifically described.

First Embodiment

FIG. 1 is a schematic drawing illustrating an example of a color image forming apparatus. A configuration and an action of an image forming apparatus of this embodiment will be described with reference to FIG. 1. The image forming apparatus of this embodiment is a so-called tandem type printer provided with image forming stations from a to d. The first image forming station a forms a yellow (Y) image, the second image forming station b forms a magenta (M) image, the third image forming station c forms a cyan (C) image, and the fourth image forming station d forms a black (Bk) image. Configurations of the respective image forming stations are the same except for the color of toner to be stored therein, and the following description will be given by using the first image forming station a.

The first image forming station a includes a drum-shaped electrophotographic photosensitive member (hereinafter, referred to as a photosensitive drum) 1*a*, a charge roller 2*a* as a charging member, a developing unit 4*a*, and a cleaning device 5*a*. The photosensitive drum 1*a* is an image bearing member configured to be driven to rotate at a predetermined circumferential velocity (process speed) to bear a toner image in a direction indicated by an arrow. The developing unit 4*a* is an apparatus including yellow toner stored therein and configured to develop yellow toner on the photosensitive drum 1*a*. The cleaning device 5*a* is a member configured to collect toner attached to the photosensitive drum 1*a*. In this embodiment, a cleaning blade as a cleaning member configured to abut against the photosensitive drum 1*a*, and a waste toner box configured to store toner collected by the cleaning blade are provided.

An image forming action is started upon reception of an image signal by a controller 100 (control unit) (see FIG. 2), and the photosensitive drum 1*a* is driven to rotate. In the process of rotation, the photosensitive drum 1*a* is subjected to a uniform charging process to a predetermined potential at a predetermined polarity (negative polarity in this embodiment) by the charge roller 2*a*, and is exposed by an exposure device 3*a* in accordance with the image signal. Accordingly, an electrostatic latent image corresponding to a yellow color component image of an intended color image is formed. Subsequently, the electrostatic latent image is developed by the developing unit (yellow developing unit) 4*a* of the developing apparatus and is visualized as a yellow toner image. Here, a normal charged polarity of the toner stored in the developing unit has a negative polarity. In this embodiment, the electrostatic latent image is formed by toner charged at the same polarity as the polarity of the photosensitive drum charged by the charge roller by reversed development. However, this disclosure may be applied to an electrophotographic apparatus configured to be capable of forming an electrostatic latent image by a toner charged at a polarity opposite to the charged polarity of the photosensitive drum by positive development.

An intermediate transfer belt 10 arranged as a transfer belt is stretched by a plurality of stretching members, namely, a drive roller 11, a tension roller 12, and an opposed roller 13, and moves by rotating at a circumferential velocity, which is substantially the same as that of the photosensitive drum 1*a*, in the same direction as the photosensitive drum 1*a* at a portion abutting and opposing the photosensitive drum 1*a*. The yellow toner image formed on the photosensitive drum 1*a* is transferred onto the intermediate transfer belt 10 in the process of passing through a contact area (hereinafter, referred to as a primary transfer portion) between the photosensitive drum 1*a* and the intermediate transfer belt 10 (primary transfer).

In this embodiment, a current flows from a secondary transfer roller 20, which is in contact with the intermediate transfer belt at the time of the primary transfer, in a circumferential direction of the intermediate transfer belt, and the current forms a primary transfer potential at the primary transfer portion in each image forming station of the intermediate transfer belt 10.

A primary transfer remaining toner remaining on the surface of the photosensitive drum 1*a* is cleaned and removed by the cleaning device 5*a*. The cleaned photosensitive drum 1*a* is provided for an image forming process from the next charging onward. Thereafter, in the same manner, a second color magenta toner image, a third color cyan toner image, and a fourth color black toner image are formed at the second, third, and fourth image forming stations b, c, and d, respectively, and these toner images are transferred onto the intermediate transfer belt 10 at the respective primary transfer portions in sequence in an overlapped manner.

A full color image corresponding to the intended color image is obtained with the process described above. A toner image with four colors on the intermediate transfer belt 10 is transferred to a surface of a recording material P supplied from a sheet feeding device 50 as a job lot in the process of passing through a secondary transfer portion formed between the intermediate transfer belt 10 and the secondary transfer roller 20 (secondary transfer). The secondary transfer roller 20 as a secondary transfer member employed here is formed of a member having an outer diameter of 18 mm obtained by covering a nickel plated steel rod having an outer diameter of 8 mm with a foamed sponge body containing NBR and epichlorohydrin rubber adjusted to a volume resistivity $10^8$ Ω·cm and a thickness of 5 mm as principal components. The secondary transfer roller 20 comes into contact with an outer peripheral surface of the intermediate transfer belt 10 at a pressing force of 50 N and forms the secondary transfer portion. The secondary transfer roller 20 is driven by the intermediate transfer belt 10 to rotate and, when secondarily transferring the toner on the intermediate transfer belt 10 to the recording material P such as paper, is applied with a secondary transfer voltage of 2500 V from a transfer power source 21 (power source circuit).

The transfer power source 21 includes a transformer configured to generate voltage, and supply secondary transfer voltage to the secondary transfer roller 20. The secondary transfer voltage supplied by the transfer power source 21 controls voltage output from the transformer to be substantially constant by the controller 100. The transfer power source 21 is capable of outputting voltage of a range from 100 V to 4000 V.

Subsequently, the recording material P having a four-color toner image bearing thereon is introduced into a fixer 30 and heated and pressurized therein, so that toners in four colors are melted and mixed and hence are fixed to the recording material P. The toner remaining on the intermediate transfer belt 10 after the secondary transfer is cleaned and removed by a cleaning device 16 provided with a cleaning blade. By the actions described above, a full-color printed image is formed.

Figure 2:
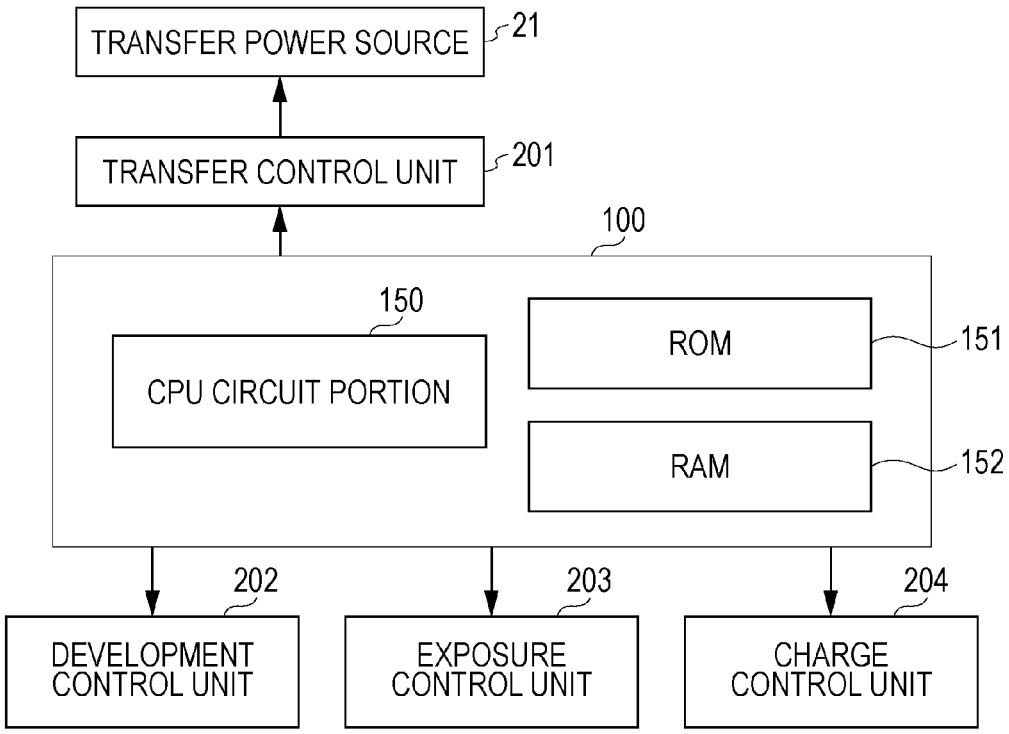
FIG. 2 is a block diagram for explaining control units that constitute parts of the image forming apparatus.

A configuration of the controller 100 configured to control the entire image forming apparatus will be described with reference to FIG. 2. The controller 100 includes a CPU circuit portion 150 as illustrated in FIG. 2. The CPU circuit portion 150 includes an ROM 151 and an RAM 152 integrated therein. The CPU circuit portion 150 controls a transfer control unit 201, a development control unit 202, an exposure control unit 203, and a charge control unit 204 across-the board in accordance with a control program stored in the ROM 151. An environment table or a paper-thickness correspondence table are stored in the ROM 151, and are reflected by being called up by the CPU. The RAM 152 is used for holding control data temporarily and is used as a working area for an arithmetic operation in accordance with the control. The transfer control unit 201 controls the transfer power source 21, and controls voltage output from the transfer power source 21 on the basis of a current value detected by a current detection circuit, not illustrated. The controller 100 controls respective control units (the transfer control unit 201, the development control unit 202, the exposure control unit 203, and the charge control unit 204) to execute the image forming action required for an printing action upon reception of image information and a printing command from a host computer (not illustrated).

The intermediate transfer belt 10 is arranged at positions opposing the respective image forming stations a to d. The intermediate transfer belt 10 is an endless belt formed by adding a conducting agent to a resin material to provide conductivity. The intermediate transfer belt 10 is stretched by three axes of the drive roller 11, the tension roller 12, and a secondary-transfer opposed roller (secondary-transfer opposed member) 13 as stretching members, and is stretched by a tensile force having a total pressure of 60 N by the tension roller 12. The intermediate transfer belt 10 is movable at the substantially same circumferential velocity with the photosensitive drums 1*a*, 1*b*, 1*c*, and 1*d* by the drive roller 11 configured to be rotated by a drive source (not illustrated) in a direction of movement of the photosensitive drums 1*a*, 1*b*, 1*c*, and 1*d* at portions abutting and opposing thereto. In the intermediate transfer belt 10, a surface between the two stretching members (the secondary transfer opposed roller 13 and the drive roller 11) and receiving toner images from the photosensitive drums 1*a*, 1*b*, 1*c*, and 1*d* by primary transfer is referred to as a primary transfer surface M.

The intermediate transfer belt 10 used in this embodiment has a circumferential length of 700 mm and a thickness of 90 μm, and is an endless polyimide resin mixed with carbon as the conductive agent. Electric characteristics of the intermediate transfer belt 10 are characterized by having electron conductive properties and having small variations in resistance value with respect to the temperature and moisture of the atmosphere.

Although the intermediate transfer belt 10 may be formed of the polyimide resin in this embodiment, other materials are also applicable as long as being a thermoplastic resin. For example, polyester, polycarbonate, polyarylate, Acrylonitrile-Butadiene-Styrene copolymer (ABS), Polyphenylenesulfide (PPS), Polyvinylidene DiFluoride (PVdF), or a mixture thereof may be used. Conductive metal oxide particles can be used as the conductive material instead of carbon.

The intermediate transfer belt 10 of this embodiment has a volume resistivity of $1\times10^{9}$ Ω·cm. Measurement of the volume resistivity is performed by using a ring probe of a type UR (Type MCP-HTP12) with a Hiresta-UP (MCP-HT450) of Mitsubishi Chemical Corporation. The measuring conditions are set to a room temperature of 23° C., a room moisture of 50%, and an applied voltage is 100V and a measuring time is 10 sec. In this embodiment, the allowable volume resistivity of the intermediate transfer belt 10 is in a range of $1\times10^{7}$ to $10^{10}$ Ω·cm.

The volume resistivity here is a scale of conductivity as a material of the intermediate transfer belt, and whether or not it is a belt capable of forming a desirable primary transfer potential by actually passing a current in the circumferential direction (hereinafter, referred to as a conductive belt) significantly depends on the magnitude of resistance in the circumferential direction.

Figure 3A:
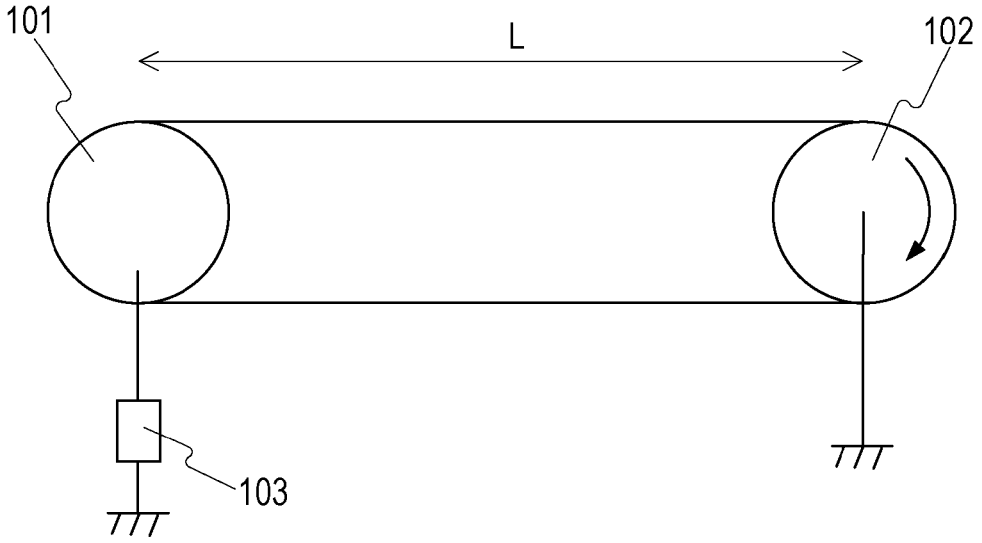
FIGS. 3A and 3B are explanatory drawings illustrating a measuring system for measuring a resistance of an intermediate transfer belt in a circumferential direction.

The circumferential resistance of the intermediate transfer belt 10 is measured by using a resistance measuring jig for the circumferential direction illustrated in FIG. 3A. A configuration of the apparatus will be described now. The intermediate transfer belt 10 to be measured is stretched by an inner roller 101 and a drive roller 102 so as not to be sagged. The inner roller 101 formed of a metal is connected to a high-voltage power source (high-voltage power source manufactured by TREK: Model_610E) 103, and the drive roller 102 is grounded. A surface of the drive roller 102 is covered with a conductive rubber having a sufficiently low resistance with respect to the intermediate transfer belt 10, and rotates so as to cause the intermediate transfer belt 10 to rotate at 100 mm/sec.

Figure 3B:
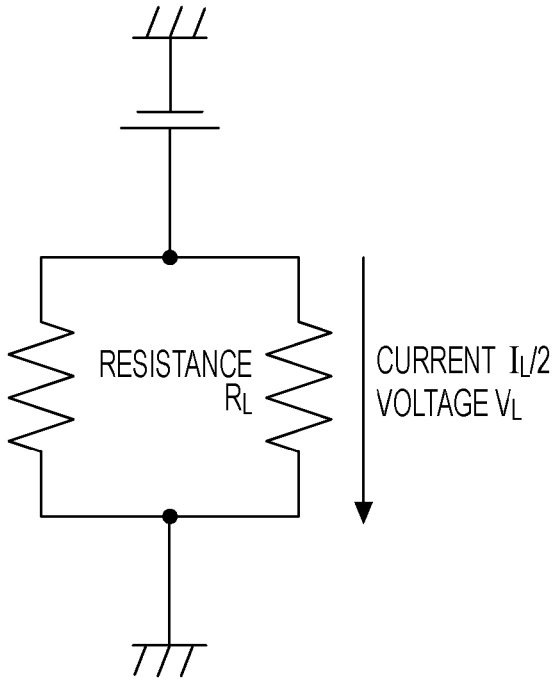

Subsequently, a measuring method will be described. In the state in which the intermediate transfer belt 10 is rotated at 100 mm/sec by the drive roller 102, a constant current IL is applied to the inner roller 101, and the voltage VL is monitored by the high-voltage power source 103 connected to the inner roller 101. A measuring system illustrated in FIG. 3A is regarded as an equivalent circuit illustrated in FIG. 3B. In this case, a resistance RL of the intermediate transfer belt 10 in the circumferential direction in a distance L between the inner roller 101 and the drive roller 102 (300 mm in this embodiment) may be calculated by RL=2VL/IL. The resistance in the circumferential direction is obtained by converting the value RL into the circumferential length of the intermediate transfer belt 10 corresponding to 100 mm. Since a current flows from a current supply member to the photosensitive drum 1 through the intermediate transfer belt 10, the circumferential resistance is preferably $1\times10^{9}$Ω or lower.

In the configuration of this embodiment, the intermediate transfer belt 10 having a circumferential resistance value of $1\times10^{8}$Ω obtained by the above-described measuring method is used. Measurement of the intermediate transfer belt 10 of this embodiment is performed at a constant current of IL=5 μA, and the monitor voltage VL at that time was 750 V. Monitoring of the monitor voltage VL performs in a segment corresponding to the circumference of the intermediate transfer belt 10, and is obtained from an average value of the segment measurement value. Since RL=2VL/IL is satisfied, RL=2×750/(5×10−6)=3×10$^8$Ω is satisfied, and if this value is converted into a segment corresponding to 100 mm, the resistance value in the circumferential direction becomes 1×108Ω. In this embodiment, the conductive belt capable of flowing a current in the circumferential direction is used as the intermediate transfer belt 10.

As regards the direction of movement of the intermediate transfer belt 10, the rigid metallic rollers 14*a*, 14*b*, 14*c*, and 14*d* are arranged in the vicinity of nip areas where the photosensitive drums 1*a*, 1*b*, 1*c*, and 1*d* and the intermediate transfer belt 10 come into contact with each other as contact members that come into contact with the intermediate transfer belt 10. The metallic rollers 14*a*, 14*b*, 14*c*, and 14*d* as the contact members will be described later in detail. A voltage maintaining element is connected to each of the metallic rollers 14*a*, 14*b*, 14*c*, and 14*d* and the opposed roller 13. The voltage maintaining element is a member configured to maintain a potential of a connected member to a predetermined potential or higher by having a current supplied thereto, and is, for example, a constant voltage element or a resistance element having a large value. Here, a zener diode 15 as the constant voltage element is connected (The drive roller 11 and the tension roller 12 are not electrically grounded so as to prevent the current from leaking and hence are in an electrically floating state.).

Hereinafter, a method of forming a primary transfer potential for performing the primary transfer of this embodiment will be described in detail. In the configuration of this embodiment, the secondary transfer power source 21 configured to apply voltage to the secondary transfer roller 20 is used as the transfer power source for performing the primary transfer. In other words, the secondary transfer power source 21 is a common transfer power source for the primary transfer and the secondary transfer, the secondary transfer roller 20 is the current supply member configured to flow a current in the circumferential direction of the intermediate transfer belt, and the secondary transfer opposed roller 13 is the opposed member of this embodiment. By using the secondary transfer power source 21 as the common transfer power source, the transfer power source specific for the primary transfer is no longer necessary, and hence cost reduction is achieved.

The secondary transfer power source 21 applies the voltage to the secondary transfer roller 20, whereby the current flows from the secondary transfer roller 20 to the intermediate transfer belt 10. The current flowing to the intermediate transfer belt 10 charges the intermediate transfer belt 10 by flowing in the circumferential direction of the intermediate transfer belt 10, and in addition, the current flows to the zener diode 15 via the opposed roller 13. By a predetermined or higher current flowing through the zener diode 15, a cathode side of the zener diode 15 is maintained at the zener voltage. The respective metallic rollers 14*a*, 14*b*, 14*c*, and 14*d* are connected to the cathode side of the zener diode 15 and are maintained at the zener voltage. In this embodiment, the current flowing in the circumferential direction of the intermediate transfer belt 10 and the respective metallic rollers 14*a*, 14*b*, 14*c*, and 14*d* maintained at the zener voltage (voltage higher than a predetermined potential) generates the primary transfer potential at the respective primary transfer portions. The primary transfer is performed by moving toner on the photosensitive drums 1*a*, 1*b*, 1*c*, and 1*d* onto the intermediate transfer belt 10 by the potential difference between the primary transfer potential and the photosensitive drum potential. In this embodiment, the primary transfer potential required for the primary transfer is determined as 150 V, and the zener voltage is determined as 300 V as a voltage to be maintained at 150 V or higher.

Figure 4:
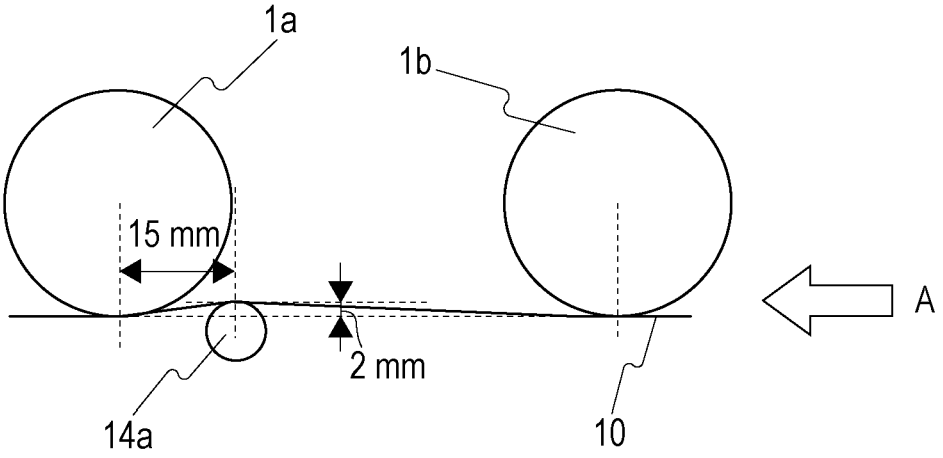
FIG. 4 is an enlarged drawing in the vicinity of a primary transfer portion of an image forming station of the first embodiment.

The rigid contact member, which is a characteristic of this embodiment, will be described in detail. FIG. 4 is an enlarged drawing in the vicinity of the primary transfer portion of the image forming station a in FIG. 1. As illustrated in FIG. 4, a metallic roller 14*a* as the contact member is arranged at a position offset by 15 mm on the downstream side of the direction of movement of the intermediate transfer belt 10 with respect to a center position of the photosensitive drum 1*a*. Therefore, the metallic roller 14*a* is arranged at a position away from the contact area between the photosensitive drum 1*a* and the intermediate transfer belt 10. The metallic roller 14*a* is arranged at a position lifted by 2 mm with respect to a horizontal plane formed by the photosensitive drum 1*a* and the intermediate transfer belt 10 so that a winding amount of the intermediate transfer belt 10 around the photosensitive drum 1*a* may be secured. In other words, the metallic roller 14*a* causes part of the intermediate transfer belt 10 to protrude toward the photosensitive drum 1*a* side so as to wind the intermediate transfer belt 10 around the photosensitive drum 1*a*.

Figure 5A:
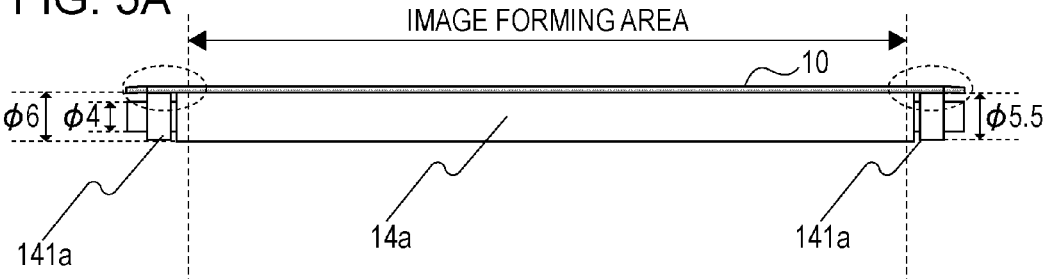
FIGS. 5A to 5C are cross-sectional views for explaining a contact member and a rotating member of the first embodiment.
Figure 5B:
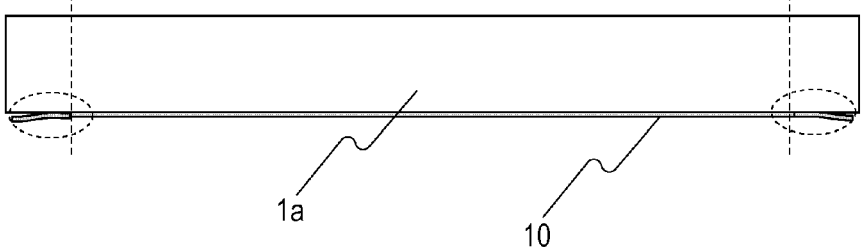
Figure 5C:
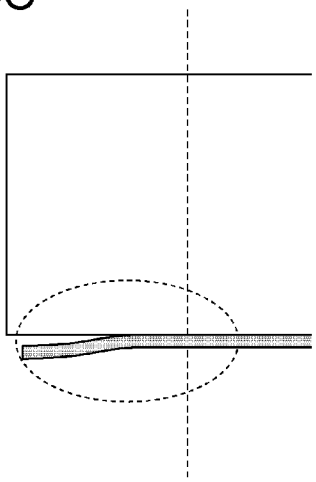

FIGS. 5A to 5C are cross-sectional views of the metallic roller 14*a* and the intermediate transfer belt 10 viewed from a direction A in FIG. 4. As illustrated in FIG. 5A, the metallic roller 14*a* is a cylindrical rigid roller having an outer diameter of 6 mm at a center portion thereof as a first outer diameter, and an outer diameter of 4 mm at both end portions thereof as second outer diameter portions in a width direction orthogonal to the direction of movement of the intermediate transfer belt 10.

The portion having an outer diameter of 6 mm at the center portion thereof corresponds to a contact area with respect to the intermediate transfer belt 10, and the portions having an outer diameter of 4 mm at the both end portions thereof correspond to shaft portions axially supported by bearings, which are not illustrated, fixed to the image forming apparatus. The length of the metallic roller 14*a* is 216 mm, and the length of the shaft portion of the metallic roller 14*a* is 12 mm in the width direction. The material of the metallic roller 14*a* is SUS coated by nickel on the surface thereof, and the metallic roller 14*a* has conductivity.

In the width direction, the length of the area where the primary transfer is performed is substantially equal to the length of the contact area of the metallic roller 14*a*. Here, considering a mounting error or the like, the length of the contact area of the metallic roller 14*a* is determined to be longer than that of an image forming area by 4 mm. The metallic rollers 14*b*, 14*c*, and 14*d* are the same as the metallic roller 14*a*, and hence description will be omitted.

Subsequently, wheels 141*a*, 141*b*, 141*c*, and 141*d* as rotating member provided at both ends of the metallic rollers 14*a*, 14*b*, 14*c*, and 14*d* will be described. The wheels 141*b*, 141*c*, and 141*d* are the same as the wheels 141*a*, and hence description will be omitted.

As illustrated in FIG. 5A, the wheels 141*a* are provided at the both end portions in the width direction of the metallic roller 14*a*. The wheels 141*a* have a cylindrical shape having an outer diameter of 5.5 mm and an inner diameter of 4 mm, and are held by allowing the shaft portions (both end portions) of the metallic roller 14*a* to pass through an inner diameter portion. An outer diameter of the wheels 141*a* is preferably selected so as to allow the intermediate transfer belt 10 from being lifted from contact portions of the metallic roller 14*a*.

When the outer diameter of the wheels 141*a* is too large, there is a probability that the intermediate transfer belt 10 or the photosensitive drum 1 is worn or scratched due to an abutment between the wheels 141*a* and the photosensitive drum 1 with the intermediate transfer belt 10 interposed therebetween. Therefore, the outer diameter of the wheels 141*a* is preferably selected so that the closest distance between the wheels 141*a* and the photosensitive drum 1*a* becomes larger than the thickness of the intermediate transfer belt 10.

Parts of outer peripheral surfaces of the wheels 141*a* are in contact with an inner peripheral surface of the intermediate transfer belt 10, and is driven to rotate by the rotation of the intermediate transfer belt 10. The wheels 141*a* are non-conductive members, have a length in the width direction of 8 mm, and are formed of PET. The expression "the wheels 141*a* are non-conductive member" here means that the material of the wheels 141*a* is a resin or rubber having no conductive filler or a conductive agent included therein.

Figure 6:
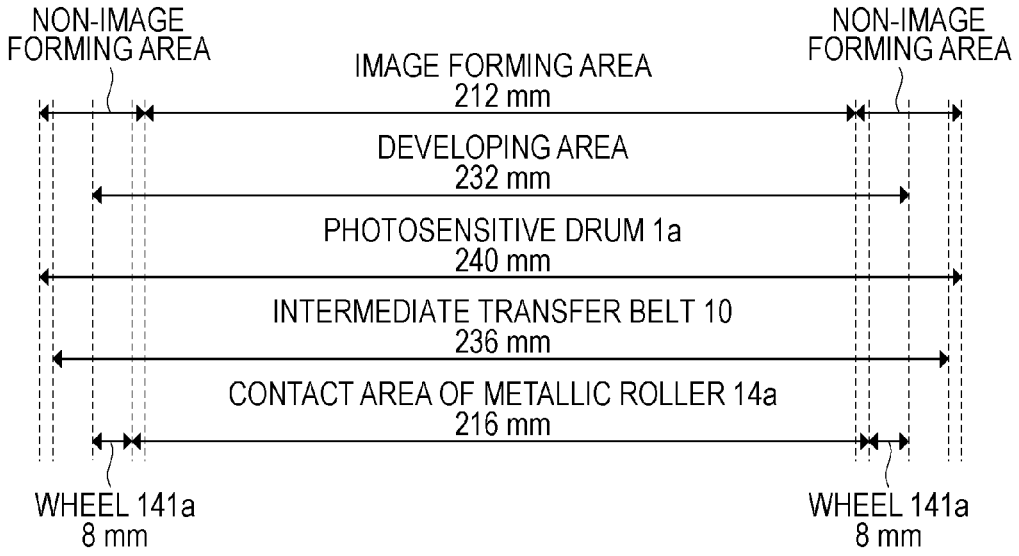
FIG. 6 is a cross-sectional view for explaining a length and a positional relationship of the contact member in a width direction of the first embodiment.

Subsequently, the lengths and the positional relationships among members of the image forming station a in the width direction (the direction of axis of the metallic roller 14*a*) will be described with reference to FIG. 6. Here, a developing area in FIG. 6 is an area in which the developing unit 4*a* is capable of developing the toner on the photosensitive drum, and the image forming area in FIG. 6 is an area in which the exposure device 3*a* is capable of forming an electrostatic latent image on the photosensitive drum 1. A non-image forming area in FIG. 6 is an area on an outside of the image forming area in the width direction.

As illustrated in FIG. 6, the developing area is located on the inside of the intermediate transfer belt 10 in the width direction. This is for preventing fogging toner developed on the photosensitive drum 1*a* in the developing area from running into the inner peripheral surface of the intermediate transfer belt 10.

The image forming area is located on the inside of the developing area in the width direction. This is for stabilizing an image concentration by preventing the image forming area from overlapping with end portions in which the amount of toner development from the developing unit 4*a* may easily become unstable. As illustrated in FIG. 6, the widths of the contact area in the width direction and the metallic roller 14*a* and the image forming area are substantially the same, and the image forming area is located within the contact area. This is for restraining the fogging toner on the photosensitive drum 1*a* from being primarily transferred onto the intermediate transfer belt 10 in the non-image forming area on the outside of the image forming area.

As illustrated in FIG. 6, the wheels 141*a* are arranged so as to be included in the contact area on the outside of the end portions of the metallic roller 14*a* and on the inside of the end portions of the intermediate transfer belt 10 in the width direction. This is for preventing the size of the image forming apparatus from increasing due to the provision of the wheels 141*a*. In the case where the wheels 141*a* are provided on the outside of the end portions of the intermediate transfer belt 10 in the axial direction, the bearings configured to hold the shaft portion of the metallic roller 14*a* are arranged further on the outside of the end portions of the intermediate transfer belt 10. Therefore, there is a probability that the size of the image forming apparatus are increased in the width direction. If the wheels 141*a* are brought into contact with the photosensitive drum 1*a* without the intermediary of the intermediate transfer belt 10, the end portions of the photosensitive drum 1*a* are ground by the wheels 141*a*, which may cause image failure. Therefore, the wheels 141*a* are arranged so as to be included within the inside of the end portions of the intermediate transfer belt 10 in the width direction.

Effects of this embodiment will be described below. As illustrated in a dot circle in FIG. 5A, the wheels 141*a* come into contact with the intermediate transfer belt 10 bent at ends of the contact portion with respect to the metallic roller 14*a*, and support the bent areas, so that bending of the intermediate transfer belt 10 is alleviated. Consequently, as illustrated in a dot circle in FIG. 5B, unevenness of contact between the photosensitive drum 1*a* and the intermediate transfer belt 10 does not occur on the inside of the end portions of the image forming area. Therefore, in the image forming area, the intermediate transfer belt 10 and the photosensitive drum 1*a* are brought into contact with each other reliably to restrain a primary transfer failure from occurring. FIG. 5C is an enlarged drawing of one end portion of FIG. 5B.

The wheels 141*a* can prevent contact between the intermediate transfer belt 10 and the both end portions of the metallic roller 14*a* (portions having an outer diameter of 4 mm). When the intermediate transfer belt 10 and the both end portions come into contact with each other, current routes from the both end portions to the intermediate transfer belt 10 are formed. However, in this embodiment, since the wheels 141*a* have non-conductivity, the current routes from the both end portions to the intermediate transfer belt 10 can be blocked. Therefore, in the non-image forming area, the primary transfer of the fogging toner on the photosensitive drum 1*a* onto the intermediate transfer belt 10 and contamination in the image forming apparatus with toner in association therewith may be restrained.

Figure 7A:
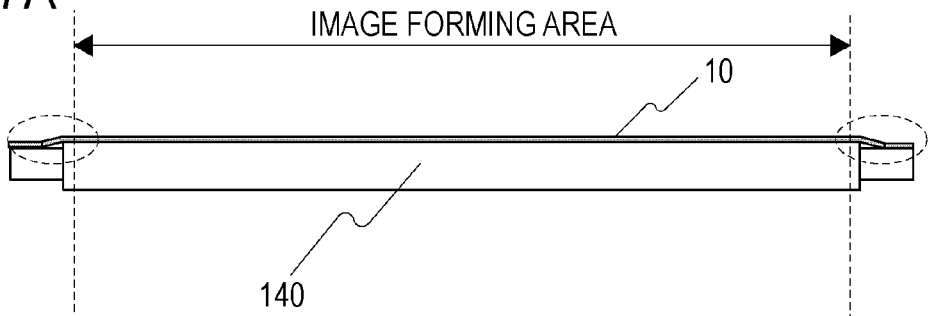
FIGS. 7A to 7C are cross-sectional views for explaining a contact member and the rotating member of Comparative Example 1.
Figure 7B:
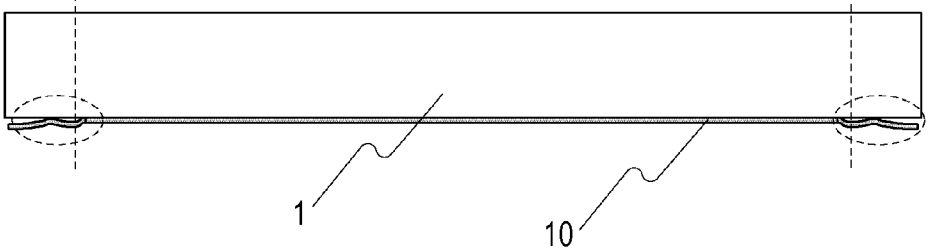
Figure 7C:
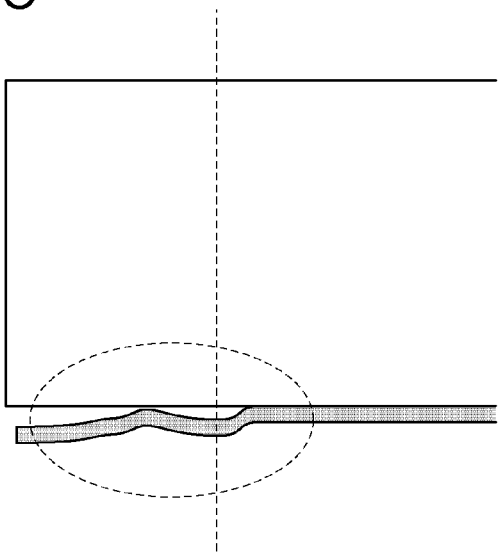

FIGS. 7A to 7C are drawings for explaining Comparative Example 1 in which a metallic roller 140 is used as the contact member, and the wheels are not arranged at both ends of the metallic roller 140. In Comparative Example 1, a contact area of the metallic roller 140 that comes into contact with the intermediate transfer belt 10 is longer than the image forming area in the width direction. As illustrated in a dot circle in FIG. 7A, since the contact member is the metallic roller 140, bending occurs in a boundary of the contact area between the metallic roller 140 and the intermediate transfer belt 10 in the same manner as FIGS. 5A to 5C.

By the intermediate transfer belt 10 being bent, the intermediate transfer belt 10 is deformed also within the contact area between the photosensitive drum 1 and the intermediate transfer belt 10. Therefore, as illustrated in a dot circle in FIG. 7B, uneven contact occurs in the contact area between the photosensitive drum 1 and the intermediate transfer belt 10. FIG. 7C is an enlarged drawing of one end side of FIG. 7B. As illustrated in FIG. 7C, by bending of the intermediate transfer belt 10 occurring at the end sides in the width direction, contact property between the intermediate transfer belt 10 and the photosensitive drum 1 is lowered within the image forming area, whereby the transfer failure occurs.

Since both end portions of the metallic roller 140 are in contact with the intermediate transfer belt 10, contamination of the area corresponding to the outside of the image forming area of the photosensitive drum 1 with toner occurs. This is because a current is supplied to the areas corresponding to the outside of the image forming area of the photosensitive drum 1 by the metallic roller 14*a* via the intermediate transfer belt 10. Therefore, in the configuration of Comparative Example 1, contact property of the contact area between the intermediate transfer belt 10 and the metallic roller 140 is lowered and, furthermore, contamination of the end portions of the photosensitive drum 1 with toner may occur.

Figure 8:
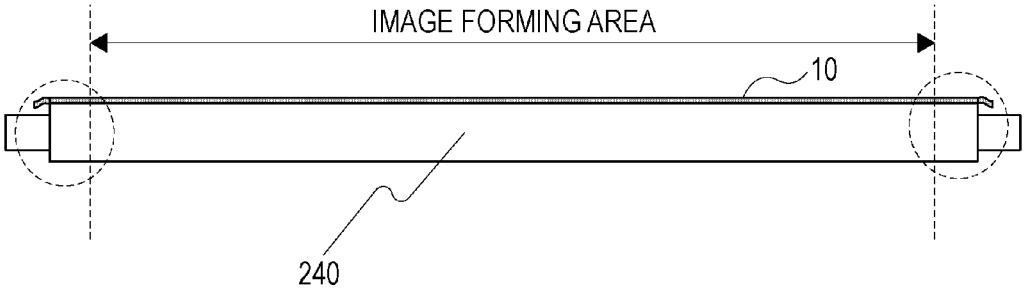
FIG. 8 is a cross-sectional view for explaining a contact member and the rotating member of Comparative Example 2.

Subsequently, Comparative Example 2 will be described. FIG. 8 is a drawing for explaining Comparative Example 2 in which a metallic roller 240, which is longer than the image forming area in the width direction, is used as the contact member, and the wheels are not arranged at both ends of the metallic roller 240. In Comparative Example 2, the contact area of the metallic roller 240 that comes into contact with the intermediate transfer belt 10 is longer than the image forming area. As in Comparative Example 2, in the case where bending of the intermediate transfer belt 10 occurs at positions apart from the end portions of the image forming area in the width direction, contact property between the intermediate transfer belt 10 and the metallic roller 240 in the image forming area is not affected. However, since the metallic roller 240 comes into contact with the non-image forming areas on the outside of the image forming area, potential is generated also in the non-image forming areas by a metallic roller 145. When the potential is generated in the non-image forming areas, toner on the photosensitive drum 1 (attached toner) may be primarily transferred onto the intermediate transfer belt 10, whereby contamination of the interior of the image forming apparatus with toner may be accelerated. Therefore, the configuration of Comparative Example 2 can hardly be employed in view of contamination with toner.

As described above, a non-conductive rotating member 141 is arranged in an area outside of the end portions of the contact area between the metallic roller 14*a* and the intermediate transfer belt 10 and inside of the end portions of the intermediate transfer belt 10 in the width direction. In this configuration, occurrence of the transfer failure in association with the bending of the intermediate transfer belt 10 and occurrence of the contamination of the photosensitive drum 1 with toner in the non-image forming area can be restrained.

In this embodiment, a configuration in which the metallic rollers 141*a*, 141*b*, 141*c*, and 141*d* are arranged on the downstream side of the contact areas between the photosensitive drums 1*a*, 1*b*, 1*c*, and 1*d* and the intermediate transfer belt 10 has been described. However, the metallic rollers 141*a*, 141*b*, 141*c*, and 141*d* may be arranged on the upstream side. Also, one each of the metallic rollers do not have to be arranged for all of the photosensitive drums 1*a*, 1*b*, 1*c*, and 1*d*, and only one metallic roller may be arranged between the photosensitive drums 1*b* and 1*c*.

Second Embodiment

In the first embodiment, a configuration in which the voltage maintaining element is connected to the metallic rollers 14*a*, 14*b*, 14*c*, and 14*d* as the contact members has been described. In contrast, in this embodiment, an intermediate transfer belt 230 higher in resistance in the circumferential direction than the belt of the first embodiment is employed and voltage is applied to the metallic rollers 14*a*, 14*b*, 14*c*, and 14*d* directly from a high-voltage power source 220. Other configurations are the same as the image forming apparatus of the first embodiment, and hence the same components will be described with the same reference numerals assigned thereto.

In the image forming apparatus of the first embodiment, the transfer power source specific for the primary transfer can be eliminated by employing the intermediate transfer belt 10 having a lower resistance in the circumferential direction. However, if the resistance of the intermediate transfer belt 10 in the circumferential direction is low, when the resistance is lowered due to the environment or wearing, the toner image may easily scatter from the intermediate transfer belt 10. Therefore, in this embodiment, the primary transfer is achieved by employing the intermediate transfer belt 230 having a resistance of $10^{10}\Omega$ or higher in the circumferential direction, and applying the transfer voltage for the primary transfer to the respective metallic rollers 14*a*, 14*b*, 14*c*, and 14*d* from the power source 220 for the primary transfer.

Figure 9:
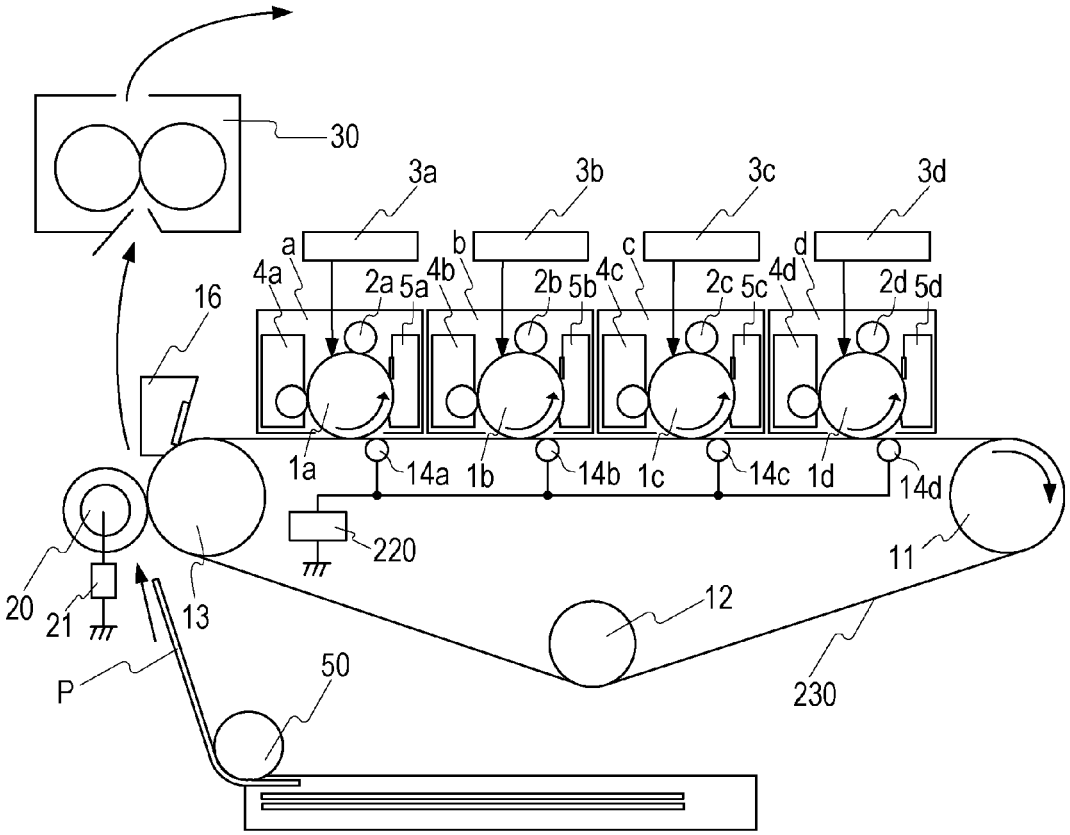
FIG. 9 is a schematic drawing for explaining the image forming apparatus of a second embodiment.

FIG. 9 is a schematic drawing for explaining the image forming apparatus of this embodiment. The intermediate transfer belt 230 is employed and primary transfer voltage is applied from the power source 220 for the primary transfer to the metallic rollers 14*a*, 14*b*, 14*c*, and 14*d*.

Figure 10A:
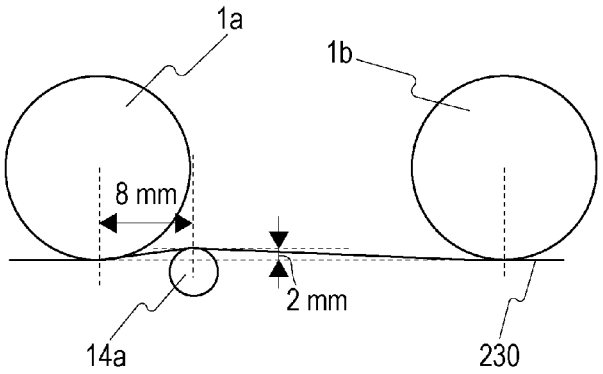
FIGS. 10A and 10B are enlarged drawings in the vicinity of the primary transfer portion of the image forming station of a second embodiment.

FIG. 10A is an enlarged drawing in the vicinity of a primary transfer portion of the image forming station a in FIG. 9. In comparison with the image forming apparatus in the first embodiment, in this embodiment, the metallic roller 14*a* is arranged at a position closer to the photosensitive drum 1*a* in terms of the direction of movement of the intermediate transfer belt 230. This is because the resistance of the intermediate transfer belt 230 is higher than that of the intermediate transfer belt 10 and a current can hardly be flowed from the metallic roller 14*a* in the circumferential direction. In this embodiment, the intermediate transfer belt 230 is arranged at a position offset toward the downstream side in terms of the direction of movement of the belt by 8 mm from a center line of the photosensitive drum 1*a*.

Figure 10B:
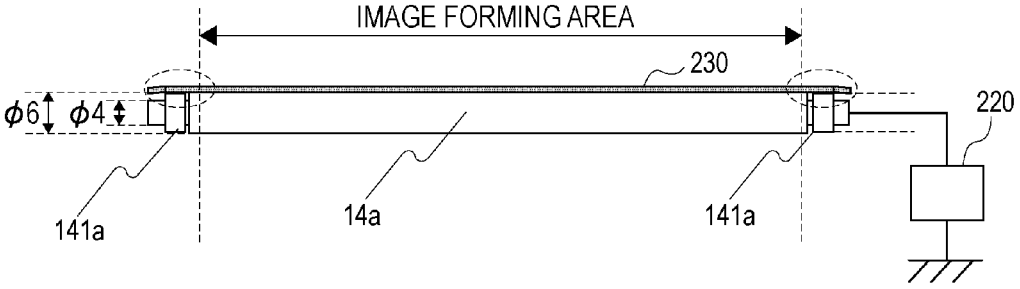

FIG. 10B is a cross-sectional view for explaining the metallic roller 14*a* and the wheels 141*a* of this embodiment. In the same manner as the first embodiment, the wheels 141*a* as non-conductive rotating members are arranged in an area on the outside of the end portions of the contact area between the metallic roller 14*a* and the intermediate transfer belt 10 and on the inside of the end portions of the intermediate transfer belt 10 in the width direction. In this configuration, transfer failure in association with the bending of the intermediate transfer belt 10 can be restrained. As illustrated in FIG. 10B, voltage is applied directly from the power source 220 to the metallic roller 14*a*. (Here, it means that the voltage is applied directly from the power source without the intermediary of the intermediate transfer belt 10, and a resistance element may be interposed between the power source 220 and the metallic roller 14*a*.) Therefore, although the both end portions (second outer diameter portions) also have the same potential as the voltage applied by the high-voltage power source 220, the voltage can be blocked by the non-conductive wheels 141*a*. Therefore, in this embodiment as well, occurrence of the contamination of the photosensitive drum 1 with toner in the non-image forming area can be restrained.

Third Embodiment

In a third embodiment, a configuration in which the wheels 141*a*, 141*b*, 141*c*, and 141*d* as the rotating members are arranged at the both end portions of the metallic rollers 14*a*, 14*b*, 14*c*, and 14*d* as the contact members has been described. In contrast, this embodiment is characterized in that the wheels 141*a*, 141*b*, 141*c*, and 141*d* are not arranged, the lengths of the respective metallic rollers 14*a*, 14*b*, 14*c* and 14*d* are extended, and non-conductive portions are provided in the extended portions. Other configurations are the same as those of the image forming apparatus of the first embodiment, and hence the same components are described with the same reference numerals assigned thereto. Since the respective image forming stations have the same configuration, the image forming station a will be described as a representative in the following description.

Figure 11A:
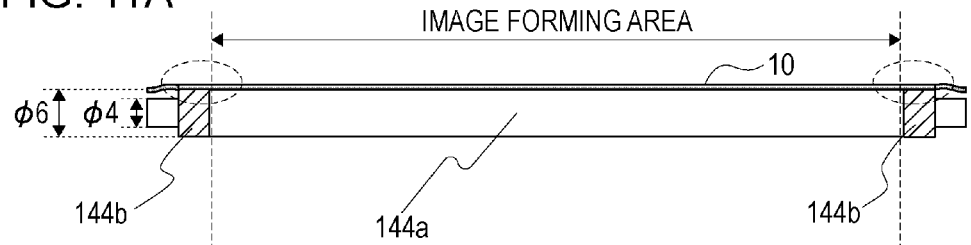
FIGS. 11A and 11B are cross-sectional views for explaining the contact member and the rotating member of a third embodiment.
Figure 11B:
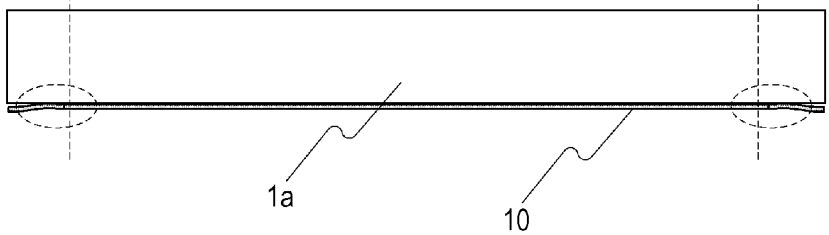

FIGS. 11A and 11B are cross-sectional views for explaining a metallic roller 144*a* as a contact member of the image forming station a of this embodiment. As illustrated by a hatched portion of FIG. 11A, the metallic roller 144*a* extended by a length of 8 mm in the width direction in comparison with that of the first embodiment is arranged in this embodiment. By supporting the non-image forming area with the metallic roller 144*a*, the bending of the intermediate transfer belt 10 is alleviated, and the uneven contact in the image forming area is restrained.

Then, the metallic roller 144*a* is provided with non-conductive portions 144*b* at both end portions thereof. Here, the non-conductive portions 144*b* is the area applied with a coating of a non-conductive resin on the area of the metallic roller 144*a* corresponding to the non-image forming area. The non-conductive resin here is a resin which does not include a conductive filler or a conductive agent. In this embodiment, application of voltage to the primary transfer portion via the intermediate transfer belt 10 from the metallic roller 144*a* in the non-image forming area is restrained by the non-conductive portions 144*b*. Therefore, in the non-image forming area, the primary transfer of the fogging toner from the photosensitive drum 1*a* onto the intermediate transfer belt 10 and contamination of the interior of the image forming apparatus with toner in association therewith may be restrained.

As described thus far, with the configuration in which the area of the contact portion of the contact member 14 with respect to the intermediate transfer belt 10 on the outside of the end portions of the image forming area in the axial direction of the contact member 14 is configured as the non-conductive portion, the primary transfer failure in association with the bending of the intermediate transfer belt 10 may be restrained. Also, occurrence of contamination of the interior of the image forming apparatus with toner in association with transfer of the fogging toner in the non-image forming area may be restrained.

In the first to the third embodiments, the image forming apparatus having the intermediate transfer belt as the transfer belt has been described. However, the configurations of the first to the third embodiments may be applied to the image forming apparatus provided with a conveying belt configured to bear and convey a transfer material as the transfer belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-256639, filed Dec. 12, 2013 which is hereby incorporated by reference herein in its entirety.

What is claimed is:

1. An image forming apparatus comprising:

an image bearing member configured to bear a latent image;

a developing unit configured to supply a toner to the latent image to develop the latent image;

a transfer belt being a movable endless belt, and configured to transfer a toner image to a transfer material;

a metallic roller having conductivity and coming into contact with an inner peripheral surface of the transfer belt; and a rotating member arranged on an outside of end portions of a contact area of the metallic roller and on an inside of end portions of the transfer belt in terms of a width direction orthogonal to a direction of movement of the transfer belt, the rotating member being configured to rotate in contact with the inner peripheral surface of the transfer belt, wherein the end portions of the contact area are located on an inside of end portions of a developing area, in terms of the width direction, wherein the developing area is only an area in which the developing unit is capable of developing the toner onto the latent image on the image bearing member, and wherein the rotating member is a non-conductive resin.

2. The image forming apparatus according to claim 1, wherein the metallic roller is arranged so that an image forming area, in which the toner image on the image bearing member is formed, is included within the contact area of the metallic roller with respect to the transfer belt of the metallic roller in the width direction, the metallic roller includes a first outer diameter portion configured to come into contact with the transfer belt and form the contact area, and a second outer diameter portion located on an outside of the first outer diameter portion in terms of the width direction having an outer diameter smaller than the first outer diameter portion, and the second outer diameter portion is axially supported by bearings.

3. The image forming apparatus according to claim 2, wherein the metallic roller is held by the second outer diameter portion.

4. The image forming apparatus according to claim 3, wherein an outer diameter of the rotating member is smaller than the first outer diameter portion of the metallic roller and is larger than the second outer diameter portion.

5. The image forming apparatus according to claim 4, wherein the rotating member is driven by the transfer belt to rotate by coming into contact with the transfer belt at a position corresponding to a non-image forming area on an outside of the image forming area in terms of the width direction.

6. The image forming apparatus according to claim 1, wherein the metallic roller is arranged in the vicinity of a nip area where the image bearing member and the transfer belt come into contact with each other in terms of the direction of movement of the transfer belt.

7. The image forming apparatus according to claim 6, wherein the metallic roller comes into contact with the transfer belt on the downstream side of the nip area in terms of the direction of movement of the transfer belt.

8. The image forming apparatus according to claim 1, wherein the metallic roller causes part of the transfer belt to protrude toward the image bearing member so as to wind the transfer belt around the image bearing member.

9. The image forming apparatus according to claim 1, wherein the transfer belt is an intermediate transfer belt to which the toner image is primarily transferred from the image bearing member.

10. The image forming apparatus according to claim 1, comprising:

a secondary transfer member configured to come into contact with an outer peripheral surface of the intermediate transfer belt and form a secondary transfer portion for secondarily transferring the toner image from the intermediate transfer belt to the transfer material;

a power source configured to apply voltage to the secondary transfer member;

an opposed member configured to oppose the secondary transfer member via the intermediate transfer belt; and a voltage maintaining element connected to the opposed member and the metallic roller, and configured to maintain the opposed member and the metallic roller at a predetermined potential or higher by receiving a supply of a current from the power source via the intermediate transfer belt.

11. The image forming apparatus according to claim 1, wherein the image bearing member includes a plurality of image bearing members configured to bear toner images of colors different from each other, and the metallic roller includes a plurality of metallic rollers opposed to the plurality of image bearing members respectively via the transfer belt.

12. The image forming apparatus according to claim 1, wherein the image bearing member includes a plurality of image bearing members configured to bear toner images of colors different from each other, the metallic roller includes a plurality of metallic rollers opposed to the plurality of image bearing members respectively, and a transfer voltage is applied from a power source to the plurality of metallic rollers, respectively.

* * * * *